US010114325B2

(12) United States Patent
Kuroda et al.

(10) Patent No.: US 10,114,325 B2
(45) Date of Patent: Oct. 30, 2018

(54) SHEET MATERIAL FEEDING APPARATUS AND IMAGE FORMING APPARATUS

(71) Applicant: KONICA MINOLTA, INC., Chiyoda-ku, Tokyo (JP)

(72) Inventors: Yoshitaka Kuroda, Hachioji (JP); Hiroshi Tanimoto, Toyokawa (JP); Yasuhiro Suzuki, Toyokawa (JP)

(73) Assignee: KONICA MINOLTA, INC., Chiyoda-ku, Tokyo (JP)

( * ) Notice: Subject to any disclaimer, the term of this patent is extended or adjusted under 35 U.S.C. 154(b) by 10 days.

(21) Appl. No.: 15/489,791

(22) Filed: Apr. 18, 2017

(65) Prior Publication Data

US 2017/0315489 A1 Nov. 2, 2017

(30) Foreign Application Priority Data

May 2, 2016 (JP) ..... 2016-092307

(51) Int. Cl.

| | |
|---|---|
| ***B65H 1/08*** | (2006.01) |
| ***G03G 15/00*** | (2006.01) |
| ***B65H 1/14*** | (2006.01) |
| ***B65H 1/26*** | (2006.01) |
| ***B65H 9/04*** | (2006.01) |
| *B65H 9/08* | (2006.01) |

(52) U.S. Cl.

CPC ..... *G03G 15/6529* (2013.01); *B65H 1/14* (2013.01); *B65H 1/266* (2013.01); *B65H 9/04* (2013.01); *B65H 9/08* (2013.01); *B65H 2801/06* (2013.01)

(58) Field of Classification Search

CPC . B65H 29/40; B65H 1/26; B65H 9/04; B65H 9/08

See application file for complete search history.

(56) References Cited

U.S. PATENT DOCUMENTS

| | | | | |
|---|---|---|---|---|
| 6,435,499 | B1 * | 8/2002 | Tomatsu | B65H 1/12 271/147 |
| 8,657,511 | B2 * | 2/2014 | Kim | B41J 13/103 271/145 |
| 2004/0164479 | A1 * | 8/2004 | Shin | B65H 1/04 271/171 |

FOREIGN PATENT DOCUMENTS

| | | |
|---|---|---|
| JP | 2000-053257 A | 2/2000 |
| JP | 2015-000802 A | 1/2015 |

* cited by examiner

*Primary Examiner* — Howard J Sanders

(74) *Attorney, Agent, or Firm* — Buchanan Ingersoll & Rooney PC

(57) ABSTRACT

A sheet material feeding apparatus includes: a cassette configured to internally contain a sheet material; a push-up plate that is mounted on an inner bottom surface of the cassette and that is a plate on top surface of which the sheet material is mounted; a push-up plate displacement mechanism configured to include push-up plate biasing members and to change a posture of the push-up plate using a biasing force of one of the push-up plate biasing members; a width regulating member configured to be displaced in a width direction intersecting with a feeding direction and to regulate a position of the sheet material; and a biasing member selecting mechanism that includes a switching unit configured to switch application and release-application of the biasing force of one of the push-up plate biasing members to a posture change of the push-up plate, in interlocking with displacement of the width regulating member.

10 Claims, 17 Drawing Sheets

SHEET MATERIAL FEEDING APPARATUS AND IMAGE FORMING APPARATUS

The entire disclosure of Japanese Patent Application No. 2016-092307 filed on May 2, 2016 including description, claims, drawings, and abstract are incorporated herein by reference in its entirety.

BACKGROUND OF THE INVENTION

Field of the Invention

The present invention relates to a sheet material feeding apparatus and an image forming apparatus including the same.

Description of the Related Art

An image forming apparatus such as a copier, a printer, and a facsimile includes a sheet material feeding apparatus that feeds a sheet material such as a sheet of paper. In some cases, the sheet material feeding apparatus includes a push-up plate that pushes up a downstream section of the sheet in a feeding direction in order to allow a top layer of the plurality of sheet materials stacked in a container unit to come in contact with a feed roller from below. There is a proposed technique capable of changing a force to push up the push-up plate in accordance with the size of the sheet material. Exemplary known techniques according to such a sheet material feeding apparatus include JP 2015-802 A and JP 2000-53257 A.

The sheet feed cassette disclosed in JP 2015-802 A includes a push-up plate, a coil spring for directly biasing the push-up plate upwardly, an auxiliary push-up plate arranged below the push-up plate, a coil spring for biasing the auxiliary push-up plate upwardly, and a regulating member for regulating the movement of the sheet in a width direction. The regulating member includes an opening engageable with a protrusion of the auxiliary push-up plate. When the regulating member is aligned with a small-sized sheet with a relatively small width, the opening of the regulating member is engaged with the protrusion on the auxiliary push-up plate, thereby preventing the auxiliary push-up plate from pushing up the push-up plate. With this mechanism, elasticity of one coil spring acts on the push-up plate for the small-sized sheet with a relatively small width, and elasticity of two coil springs acts on the push-up plate for the large-sized sheet with a relatively large width.

A sheet feed apparatus described in JP 2000-53257 A includes a movable base plate, a pressure lever and an auxiliary pressure lever for biasing the movable base plate upwardly, and a side fence for regulating the movement of the sheet in the width direction. The side fence includes a projection engageable with the auxiliary pressure lever. When the side fence is aligned with a large-sized sheet with a relatively large width, a projection on the side fence engages with the auxiliary pressure lever, whereby a biasing force of the auxiliary pressure lever acts on the movable base plate. With this mechanism, the biasing force of one lever acts on the push-up plate for the small-sized sheet with a relatively small width, and the biasing force of two levers acts on the push-up plate for the large-sized sheet with a relatively large width.

Unfortunately, however, the sheet feed cassette described in JP 2015-802 A has a difficulty in engaging the protrusion of the auxiliary push-up plate with the opening of the regulating member unless the cassette is in a state of being completely drawn out from a main body, and this leads to incompatibility with a small-sized sheet having a relatively small width. This limitation might lead to a concern of extra time and labor on a user.

Another sheet feed apparatus described in JP 2000-53257 A includes the projection on the side fence, that comes in direct contact with the auxiliary pressure lever, leading to a concern of an unintentional force to be applied on the side fence. This would be a concern of adversely affecting the sheet feed performance. Furthermore, since a pressure arm, a pressure lever, and an auxiliary pressure lever for upwardly biasing the movable base plate inside a sheet feet tray are provided outside the sheet feed tray, there are concerns of enlargement of the sheet feed apparatus and thus, enlargement of the image forming apparatus.

SUMMARY OF THE INVENTION

The present invention has been made in view of the above-described issue, and an object thereof is to provide a downsized sheet material feeding apparatus and an image forming apparatus, capable of suitably changing the force to push up the sheet material in accordance with the size of the sheet material and achieving stable feeding of the sheet material.

To achieve the abovementioned object, according to an aspect, a sheet material feeding apparatus reflecting one aspect of the present invention comprises: a cassette configured to internally contain a sheet material; a push-up plate that is mounted on an inner bottom surface of the cassette and that is a plate on top surface of which the sheet material is mounted; a push-up plate displacement mechanism that is provided on the cassette and configured to include a plurality of push-up plate biasing members and to change a posture of the push-up plate using a biasing force of at least one of the push-up plate biasing members; a width regulating member provided inside the cassette and configured to be displaced in a width direction intersecting with a feeding direction of the sheet material and to regulate a position of the sheet material in the width direction; and a biasing member selecting mechanism that is provided on the cassette and includes a switching unit configured to switch application and release-application of the biasing force of at least one of the push-up plate biasing members to a posture change of the push-up plate, in interlocking with displacement of the width regulating member.

With this configuration, it is possible to easily displace the width regulating member regardless of drawn out/stored states of the cassette with respect to the housing unit, leading to the switching of application and release-application of the biasing force by the push-up plate biasing member, to the posture change of the push-up plate. Moreover, a switching unit exists between the width regulating member and the push-up plate biasing member. This configuration suppresses application of an unintentional force to the width regulating member and stabilizes sheet material feeding performance. Moreover, since the push-up plate displacement, mechanism and the biasing member selecting mechanism are provided on the cassette, it is possible to form the sheet material feeding apparatus relatively in a small size.

In the sheet material feeding apparatus with the above configuration, the push-up plate displacement mechanism preferably includes: a rotation shaft that is arranged below the push-up plate and extends in the width direction of the sheet material; a plurality of pivot levers to which an end of at least one of the push-up plate biasing members is separately connected and capable of rotating around an axial line of the rotation shaft, together with the rotation shaft; and a push-up lever arranged below the push-up plate and configured to be attached on the rotation shaft and to change a posture of the push-up plate in accordance with rotation of the rotation shaft, and the biasing member selecting mechanism is preferably configured such that the switching unit includes a coupling member capable of performing engagement and disengagement of the pivot lever to which at least one of the push-up plate biasing members are connected, with the rotation shaft, and the biasing member selecting mechanism preferably includes: an engagement biasing member configured to bias, on the switching unit, the pivot lever to which at least one of the push-up plate biasing members is connected, in a direction to engage with the rotation shaft; and a disengagement, lever configured to come in contact with the width regulating member, and configured to displace, on the switching unit, the pivot lever to which at least one of the push-up plate biasing members is connected, in a direction to disengage from, the rotation shaft, by being displaced in interlocking with displacement of the width regulating member.

In the sheet material feeding apparatus with the above configuration, an end of each of the push-up plate biasing members is preferably separately connected to each of the plurality of pivot levers and the plurality of pivot levers can rotate, together with the rotation shaft, around an axial line of the rotation shaft.

In the sheet material feeding apparatus with the above configuration, the direction of the biasing force of the engagement biasing member received at a contact position with the disengagement lever, on the width regulating member, is preferably parallel with the feeding direction of the sheet material.

In the sheet material feeding apparatus with the above configuration, the disengagement lever can preferably rotate within a plane parallel with an inner bottom surface of the cassette, and a distance from a rotation center of the disengagement lever to a connection position of the disengagement lever with the switching unit in the feeding direction of the sheet material is preferably longer than a distance from the rotation center of the disengagement lever to a contact position of the disengagement lever with the width regulating member in the feeding direction of the sheet material.

In the sheet material feeding apparatus with the above configuration, the sheet material feeding apparatus preferably further comprises a housing unit, wherein the cassette can be preferably drawn out from or stored into the housing unit, and the cassette preferably includes a starting lever connected to the push-up plate displacement mechanism and configured to come in contact with the housing unit together with the storage of the cassette into the housing unit to change the posture of the push-up plate so as to be pushed up by activating the biasing force of the push-up plate biasing member in the push-up plate displacement mechanism.

To achieve the abovementioned object, according to an aspect, an image forming apparatus reflecting one aspect of the present invention comprises: a sheet material feeding apparatus configured to feed a sheet material; and a printing unit configured to form an image on the sheet material fed from the sheet material feeding unit, wherein the sheet material feeding apparatus includes: a cassette configured to internally contain the sheet material; a push-up plate that is mounted on an inner bottom surface of the cassette and that is a plate on top surface of which the sheet material is mounted; a push-up plate displacement mechanism that is provided on the cassette and configured to include a plurality of push-up plate biasing members and to change a posture of the push-up plate using a biasing force of at least one of the push-up plate biasing members; a width regulating member provided inside the cassette and configured to be displaced in a width direction intersecting with a feeding direction of the sheet material and to regulate a position of the sheet material in a width direction; and a biasing member selecting mechanism that is provided on the cassette and includes a switching unit configured to switch application and release-application of the biasing force of at least one of the push-up plate biasing members to a posture change of the push-up plate, in interlocking with displacement of the width regulating member.

In the image forming apparatus with the above configuration, the push-up plate displacement mechanism preferably includes: a rotation shaft that is arranged below the push-up plate and extends in the width direction of the sheet material; a plurality of pivot levers to which an end of at least one of the push-up plate biasing members is separately connected and capable of rotating around an axial line of the rotation shaft, together with the rotation shaft; and a push-up lever arranged below the push-up plate and configured to be attached on the rotation shaft and to change a posture of the push-up plate in accordance with rotation of the rotation shaft, and the biasing member selecting mechanism is preferably configured such that the switching unit includes a coupling member capable of performing engagement and disengagement of the pivot lever to which at least one of the push-up plate biasing members are connected, with the rotation shaft, and the biasing member selecting mechanism preferably includes: an engagement biasing member configured to bias, on the switching unit, the pivot lever to which at least one of the push-up plate biasing members is connected, in a direction to engage with the rotation shaft; and a disengagement lever configured to come in contact with the width regulating member, and configured to displace, on the switching unit, the pivot lever to which at least one of the push-up plate biasing members is connected, in a direction to disengage from the rotation shaft, by being displaced in interlocking with displacement of the width regulating member.

In the image forming apparatus with the above configuration, an end of each of the push-up plate biasing members is preferably separately connected to each of the plurality of pivot levers and the plurality of pivot levers can rotate, together with the rotation shaft, around an axial line of the rotation shaft.

In the image forming apparatus with the above configuration, the direction of the biasing force of the engagement biasing member received at a contact position with the disengagement lever, on the width regulating member, is preferably parallel with the feeding direction of the sheet material.

In the image forming apparatus with the above configuration, the disengagement lever can preferably rotate within a plane parallel with an inner bottom surface of the cassette, and a distance from a rotation center of the disengagement lever to a connection position of the disengagement lever with the switching unit in the feeding direction of the sheet material is preferably longer than a distance from the rotation center of the disengagement lever to a contact position of the disengagement lever with the width regulating member in the feeding direction of the sheet material.

In the image forming apparatus with the above configuration, the sheet material feeding apparatus preferably further includes a housing unit, the cassette can be preferably drawn out from or stored into the housing unit, and the cassette preferably includes a starting lever connected to the push-up plate displacement mechanism and configured to come in contact with the housing unit together with the storage of the cassette into the housing unit to change the posture of the push-up plate so as to be pushed up by activating the biasing force of the push-up plate biasing member in the push-up plate displacement mechanism.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein.

DESCRIPTION OF THE PREFERRED EMBODIMENTS

Hereinafter, an embodiment of the present invention will be described with reference to the drawings. However, the scope of the invention is not limited to the illustrated examples.

Figure 1:
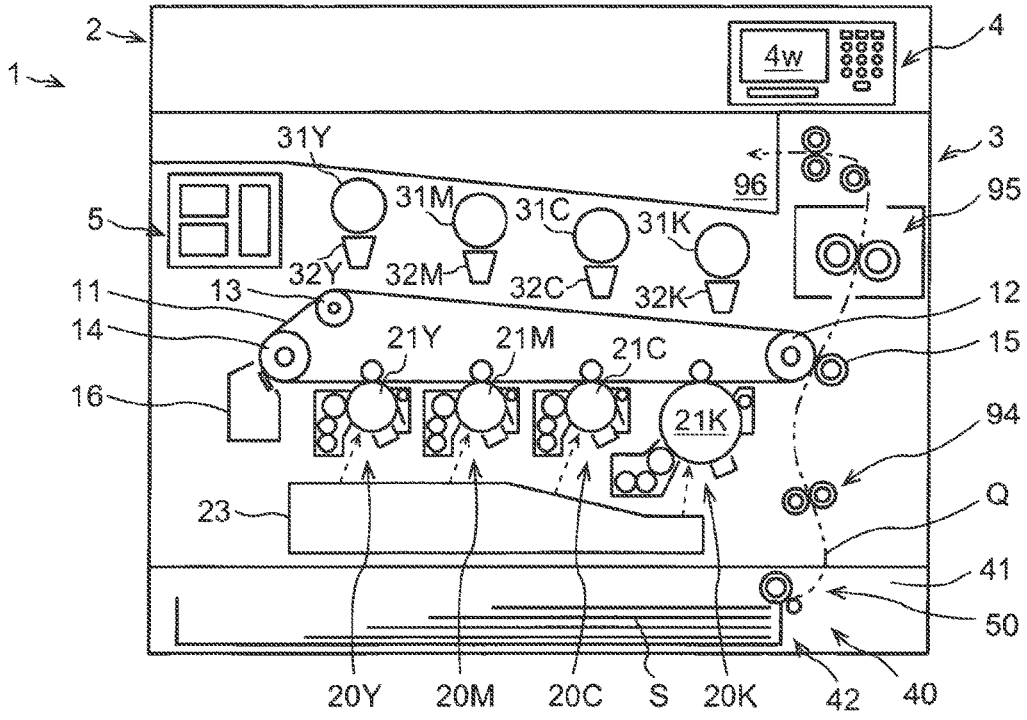
FIG. 1 is a partial vertical cross-sectional front view of an image forming apparatus according to an embodiment of the present invention.

First, an outline of the structure of an image forming apparatus according to an embodiment of the present invention will be described with reference to FIG. 1, together with image output operation. FIG. 1 is a partial vertical cross-sectional front view of the image forming apparatus. Note that an arrowed two-dot chain line in the diagram indicates a conveyance path and a conveyance direction of the sheet material.

An image forming apparatus 1 is a tandem type color copier as illustrated in FIG. 1, including an image reading unit 2, a printing unit 3, an operation unit 4, and a main control unit 5. The image reading unit 2 reads an image of a document. The printing unit 3 prints the read image on a sheet material such as a sheet of paper. The operation unit 4 is used to input print conditions and a display operation status.

The image reading unit 2 is a known unit configured to read an image of a document placed on a top surface of platen glass (not illustrated) by moving a scanner (not illustrated). The image on the document undergoes color separation to be three colors of red (R), green (G), and blue (B), and then, is converted into an electrical signal by a charge coupled device (CCD) (not illustrated). With this processing, the image reading unit 2 obtains image data of different colors of red (R), green (G), and blue (B).

After undergoing various types of processing on the main control unit 5, the image data of different colors obtained by the image reading unit 2 is converted into image data of individual reproduced colors of yellow (Y), magenta (M), cyan (C), and black (K) and stored in a memory (not illustrated) in the main control unit 5. After undergoing misalignment correction processing, the image data of the individual reproduced colors stored in the memory is read per scanning line in synchronization with the conveyance of the sheet material in order to perform optical scanning toward a photosensitive drum 21 as an image bearing body.

The printing unit 3 forms an image by electrophotography and transfers the image to the sheet material. The printing unit 3 includes an intermediate transfer belt 11 formed as an endless belt from an intermediate transfer body. The intermediate transfer belt 11 is wound around a driving roller 12, a tension roller 13, and a driven roller 14. The tension roller 13 is upwardly biased as illustrated in FIG. 1 by a spring (not illustrated), thereby giving tension to the intermediate transfer belt 11. The intermediate transfer belt 11 is rotated counterclockwise as illustrated in FIG. 1 by the driving roller 12.

The driving roller 12 comes in pressing contact with the secondary transfer roller 15 at an opposing position across the intermediate transfer belt 11. At a position of the driven roller 14, an intermediate transfer cleaning unit 16 comes in contact with an outer peripheral surface of the intermediate transfer belt 11. The intermediate transfer cleaning unit 16 is provided to oppose the driven roller 14 across the intermediate transfer belt 11. After the toner image formed on the outer peripheral surface of the intermediate transfer belt 11 is transferred to a sheet material S, the intermediate transfer cleaning unit 16 performs cleaning by removing foreign matters such as toner remaining on the outer peripheral surface of the intermediate transfer belt 11.

Below the intermediate transfer belt 11, provided are image forming units 20Y, 20M, 20C, and 20K corresponding to the individual reproduced colors of yellow (Y), magenta (M), cyan (C), and black (K). Note that hereinafter, these will be collectively referred to, in some cases, as "the image forming unit(s) 20" omitting description of identification signs of "Y", "M", "C", and "K" unless there is a need to distinguish between each other. The four image forming units 20 are arranged in a line along a rotational direction of the intermediate transfer belt 11, from the upstream side to the downstream side in the rotational direction. The configuration of the four image forming units 20 is the same, that is, each of the units include a charging unit, an exposure unit, a developing unit, a drum cleaning unit, and a primary transfer roller, around the photosensitive drum 21 that rotates clockwise in FIG. 1.

A scanning optical apparatus 23, as an exposure unit, is arranged below the image forming units 20. The single scanning optical apparatus 23 handles the four image forming units 20 and includes four light sources (not illustrated) such as semiconductor laser beams respectively corresponding to each of the four photosensitive drums 21. The scanning optical apparatus 23 modulates four semiconductor laser beams into image gradation data of individual reproduced colors and separately emits laser beams that correspond to individual reproduced colors, to the four photosensitive drum 21.

A toner bottle 31 and a toner hopper 32 corresponding to the four image forming units 20 for individual reproduced colors are provided above the intermediate transfer belt 11. For each of the exposure unit and the toner hopper 32, a remaining amount detection unit (not illustrated) to detect individual remaining toner amount inside each of the units is provided Moreover, a toner supply apparatus (not illustrated) is provided between the exposure unit and the toner hopper 32, and between the toner hopper 32 and the toner bottle 31. When the remaining amount detection unit detects a decrease in the toner remaining amount inside the exposure unit, the supply apparatus drives so as to prompt the toner hopper 32 to supply toner to the exposure unit. Furthermore, when the remaining amount detection unit detects a decrease in the toner remaining amount inside the toner hopper 32, the supply apparatus drives so as to prompt the toner bottle 31 to supply toner to the toner hopper 32. The toner bottle 31 is removably attached onto an apparatus main body and can be replaced appropriately.

A sheet material feeding apparatus 40 that internally contains a plurality of the sheet materials S such as sheets of paper, below the scanning optical apparatus 23. The sheet material S contained in the sheet material feeding apparatus 40 is sequentially fed one by one from a top layer thereof to a sheet material conveyance path Q by a feeding unit 50. The sheet material S fed from the sheet material feeding apparatus 40 to the sheet material conveyance path Q reaches a position of a pair of registration rollers 94. Subsequently, the pair of registration rollers 94 feeds the sheet material S toward a contact portion (secondary transfer nip portion) between the intermediate transfer belt 11 and the secondary transfer roller 15 in synchronization with the rotation of the intermediate transfer belt 11 while correcting skewed feeding (skew correction) of the sheet material S.

The image forming unit 20 operates such that the laser beam emitted from the scanning optical apparatus 23 forms an electrostatic latent image on the surface of the photosensitive drum 21, and then, the electrostatic latent image is visualized as a toner image by the exposure unit. The toner image formed on the surface of the photosensitive drum 21 is primarily transferred to the outer peripheral surface of the intermediate transfer belt 11, at a position where the photosensitive drum 21 opposes the primary transfer roller across the intermediate transfer belt 11. Subsequently, with the process of sequential transfer, at a predetermined timing, of the toner images of the individual image forming units 20 onto the intermediate transfer belt 11 along with the rotation of the intermediate transfer belt 11, a color toner image formed by overlapping toner images in four colors of yellow, magenta, cyan, and black is formed on the outer peripheral surface of the intermediate transfer belt 11.

The color toner image primarily transferred onto the outer peripheral surface of the intermediate transfer belt 11 is transferred to the sheet material S fed in synchronization by the pair of registration rollers 94, at the second transfer nip portion formed by the contact of the intermediate transfer belt 11 with the secondary transfer roller 15.

A fixing unit 95 is provided above the second transfer nip portion. The sheet material S on which an unfixed toner image has been transferred at the second transfer nip portion is fed to the fixing unit 95, sandwiched between the heating roller and the pressure roller, whereby the toner image is heated, pressurized, and fixed onto the sheet material S. The sheet material S that has passed through the fixing unit 95 is discharged to a sheet material discharge unit 96 provided above the intermediate transfer belt 11.

The operation unit 4 is provided on a front side of the image reading unit 2. The operation unit 4 receives an input of printing condition setting such as the type and size of the sheet material S to be used for printing by the user, enlargement/reduction, double-face printing on/off, and an input of setting such as fax number and transmitter's name in facsimile transmission. Moreover, the operation unit 4 also functions as a notification unit for notifying to the user, apparatus states, cautions, error messages, or the like, by displaying those on a display unit 4*w*.

In order to perform overall operation control, the image forming apparatus 1 includes the main control unit 5 constituted with a CPU, an image processing unit, and other electronic components (all not illustrated). Using the CPU as a central processing unit, and an image processing unit, the main control unit 5 implements a series of image forming operation and printing operation by controlling constituents such as the image reading unit 2 and the printing unit 3 on the basis of programs and data stored and input into the memory.

Figure 2:
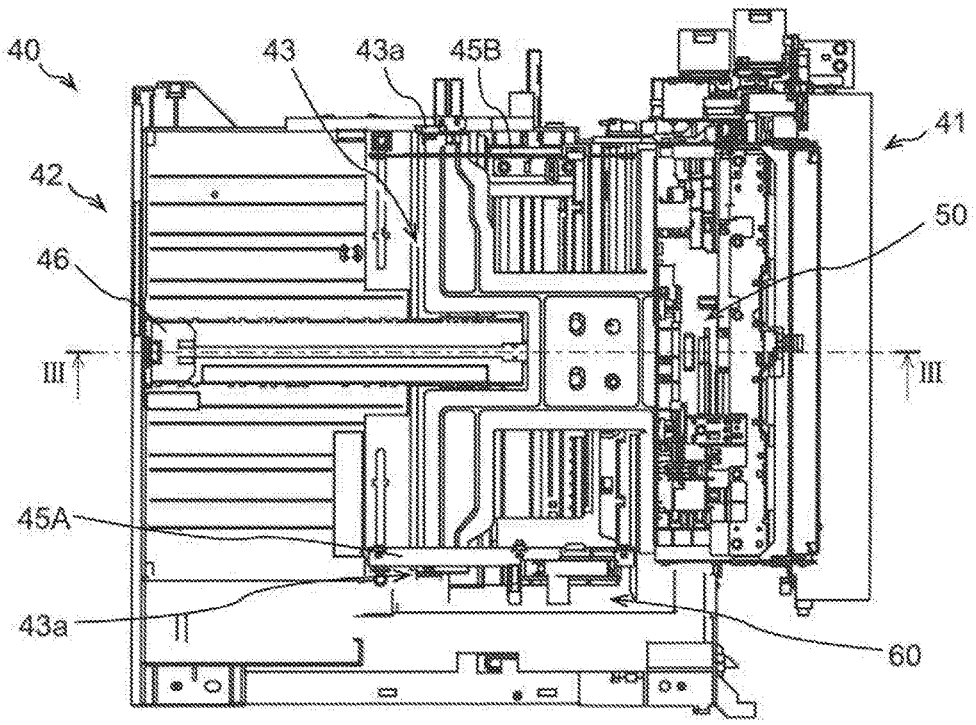
FIG. 2 is a top view of a sheet material feeding apparatus of the image forming apparatus according to an embodiment of the present invention.
Figure 3:
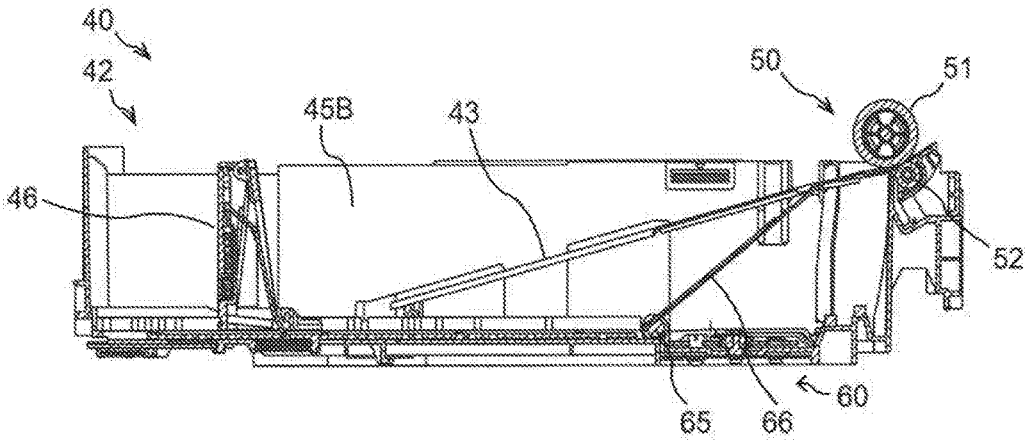
FIG. 3 is a vertical cross-sectional front view of a sheet material feeding apparatus of the image forming apparatus according to an embodiment of the present invention.
Figure 4:
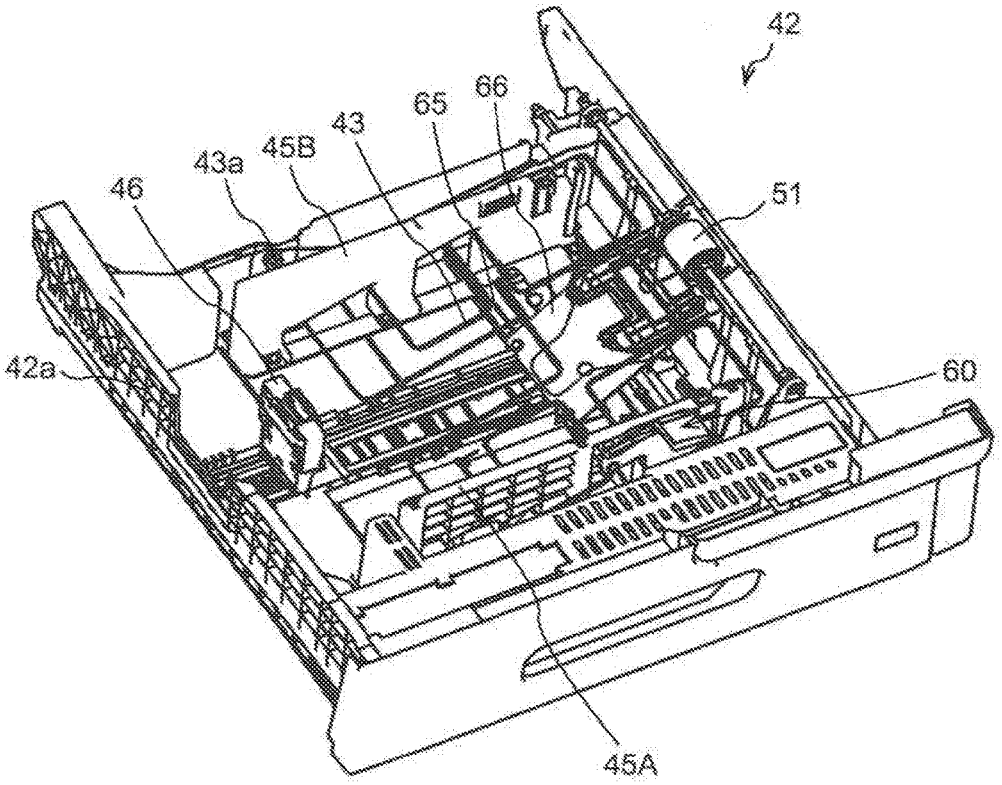
FIG. 4 is a perspective view of a sheet material feeding apparatus according to an embodiment of the present invention when a cassette is stored.
Figure 5:
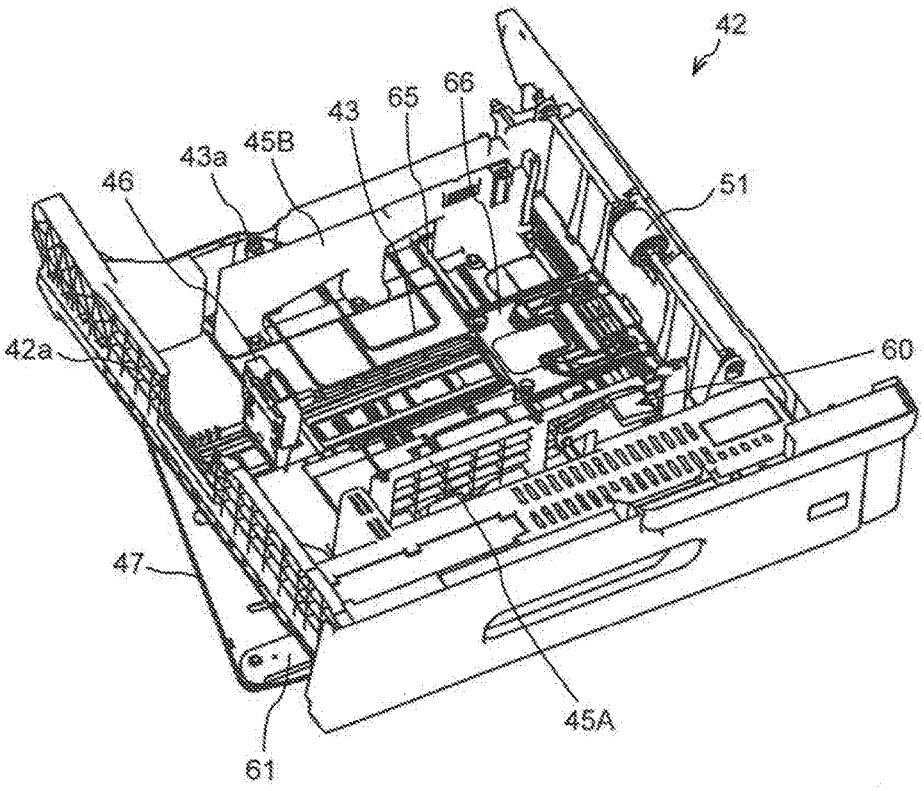
FIG. 5 is a perspective view of a sheet material feeding apparatus according to an embodiment of the present invention when a cassette is drawn out.

Subsequently, the configuration of the sheet material feeding apparatus 40 of the image forming apparatus 1 will be described with reference to FIGS. 2 to 5. FIGS. 2 and 3 are a top view and a vertical cross-sectional front view of the sheet material feeding apparatus 40, respectively. FIGS. 4 and 5 are perspective views of the sheet material feeding apparatus 40 when the cassette is stored and drawn out, respectively. Note that FIG. 3 is a vertical cross-sectional diagram taken at line III-III in FIG. 2, omitting a drawing of a portion of an upstream-side section of the sheet material in the conveyance direction. Moreover, a push-up plate 43 described below is illustrated solely by outline in FIGS. 4 and 5.

The lower side in FIG. 2 corresponds to the front side of the sheet material feeding apparatus 40. The upper side in FIG. 2 corresponds to the back side of the sheet material feeding apparatus 40. The up-down direction in FIG. 3 corresponds to the up-down direction of the sheet material feeding apparatus 40. The left-right, direction in FIG. 3 corresponds to the left-right direction of the sheet material feeding apparatus 40.

The sheet material feeding apparatus 40 includes a housing unit 41 and a cassette 42, as illustrated in FIGS. 2 and 3. The cassette 42 is a sheet material container unit for containing inside itself sheet materials such as cut sheets of paper before printing. The cassette 42 is formed into a flat box shape with an opening on an upper surface, and sheet materials are mounted from this upper surface direction to be stored. Note that the sheet materials are fed in the right direction in FIGS. 2 and 3 with respect to the cassette 42 by the operation of the feeding unit 50 described in detail below.

The cassette 42 is slidable along a guide section (not illustrated) extending in the front-back direction between the cassette 42 and the housing unit 41 horizontally with respect to the housing unit 41. The cassette 42 can be drawn out or contained from/into the housing unit 41 by operation of being drawn out or pushing in, in the front-back direction of the cassette 42.

The push-up plate 43 is arranged on an inner bottom surface of the cassette 42. The sheet materials are mounted and stacked on the push-up plate 43. The push-up plate 43 is supported by the inner side wall of the cassette 42 with a support shaft 43*a* extending in the front-back direction provided at an upstream end of in the sheet material feeding direction, that is, at a left end portion in FIG. 2. The push-up plate 43 is arranged to be swingable within a vertical plane around the support shaft 43*a*, with a downstream end (right end portion) in the sheet material feeding direction being defined as a free end. The inclination angle of the push-up plate 43 in the sheet material feed direction changes in accordance with the loading amount of the sheet material loaded on the top surface of the plate. The support shaft 43*a* is disposed at two positions, that is, the front side and the back side of the push-up plate 43.

The push-up plate displacement mechanism 60 described below is arranged (refer to FIGS. 6 and 7) below the downstream section of the push-up plate 43 in the feeding direction of the sheet material, at a position between oneself and an inner bottom surface of the cassette 42, and on the front side of the push-up plate 43, and on the outer bottom surface of the cassette 42. When the cassette 42 is stored into the housing unit 41, the push-up plate displacement mechanism 60 operates, and a downstream section of the push-up plate 43 in the sheet material feeding direction is raised. When the cassette 42 is drawn out from the housing unit 41, the push-up plate displacement, mechanism 60 operates, and the push-up plate 43 is folded onto the inner bottom surface of the cassette 42. In this manner, the push-up plate displacement mechanism 60 changes the posture of the push-up plate 43.

The feeding unit 50 is arranged in the housing unit 41, above the downstream section of the cassette 42 in the sheet material feeding direction. The feeding unit 50 feeds the sheet material contained in the cassette 42, to the outside of the cassette 42. The feeding unit 50 includes a feed roller 51 and a separating roller 52 illustrated in FIG. 3.

The feed roller 51 is arranged above the downstream section of the push-up plate 43 in the sheet material feeding direction. When the downstream section in the sheet material feeding direction of the sheet material mounted on the push-up plate 43 is pushed up by the push-up plate 43, the top layer of the sheet material comes in pressing contact with the feed roller 51. The sheet material S in the cassette 42 is fed to the outside of the cassette 42 by the feed roller 51.

The feed roller 51 is arranged such that a lower portion of the surface thereof protrudes toward the sheet material conveyance path Q (illustrated in FIG. 1) extending from the sheet material feeding apparatus 40 to the outside thereof. The feed roller 51 is connected to a motor (not illustrated) and rotated.

The separating roller 52 is disposed below the feed roller 51 across the sheet material conveyance path Q. The separating roller 52 comes in pressing contact with the feed roller 51 by an action of the biasing member (not illustrated). The sheet material is inserted through a nip portion formed by the contact of the separating roller 52 with the feed roller 51. The separating roller 52 is not connected with the motor but rotates in accordance with the rotation of the feed roller 51 by the contact with the feed roller 51.

The separating roller 52 includes a torque limiter (not illustrated), for example, at its shaft portion. When the sheet material is not present at the nip portion formed by the contact of the separating roller 52 with the feed roller 51, or a single sheet material enters there, a torque that is a set torque of the torque limiter or above is applied onto the separating roller 52, and the separating roller 52 rotates in a direction of feeding the sheet material in accordance with the feed roller 51. In contrast, when a plurality of overlapping sheet materials enters the nip portion, the torque applied to the separating roller 52 does not reach the set torque of the torque limiter, and then, the separating roller 52 stops rotation. This configuration avoids feeding of the lower-side sheet material among the overlapping sheet materials, making it possible to prevent a problem of double feeding, that is, feeding of overlapping sheet materials.

Width regulating members 45A and 45B are arranged inside the cassette 42, specifically, at both end portions in a direction intersecting with the feeding direction of the sheet materials mounted on the push-up plate 43, that is, the front and back sides of the sheet materials. The width regulating members 45A and 45B can be displaced in a width direction of the sheet material, that is, the direction intersecting with the feeding direction of the sheet material, and can come in contact with a front-side end surface and a back-side end surface of a bundle of the sheet materials. This configuration enables the width regulating members 45A and 45B to regulate the position of the sheet materials in the width direction.

Inside the cassette 42, a rear-end regulating member 46 is arranged on an upstream side of the feeding direction of the sheet material mounted on the push-up plate 43. One rear-end regulating member 46 is provided at a central portion of the width direction of the sheet material, that is, the direction intersecting with the feeding direction of the sheet material. The rear-end regulating member 46 can be displaced in parallel with the sheet material feeding direction, and can come in contact with an end surface (rear end) on the upstream side in the feeding direction of the bundle of the sheet materials. This configuration enables the rear-end regulating member 46 to regulate the position of the sheet material at an upstream end in the feeding direction.

Figure 6:
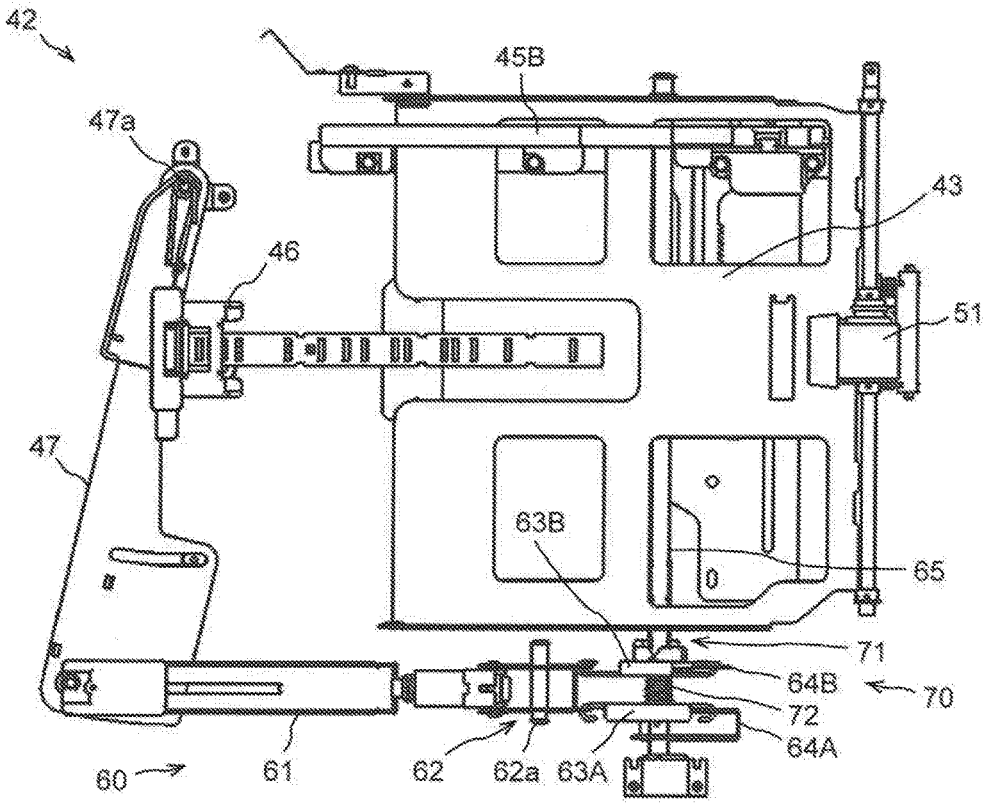
FIG. 6 is a partial plan view of the sheet material feeding apparatus according to an embodiment of the present invention when a cassette is drawn out.
Figure 7:
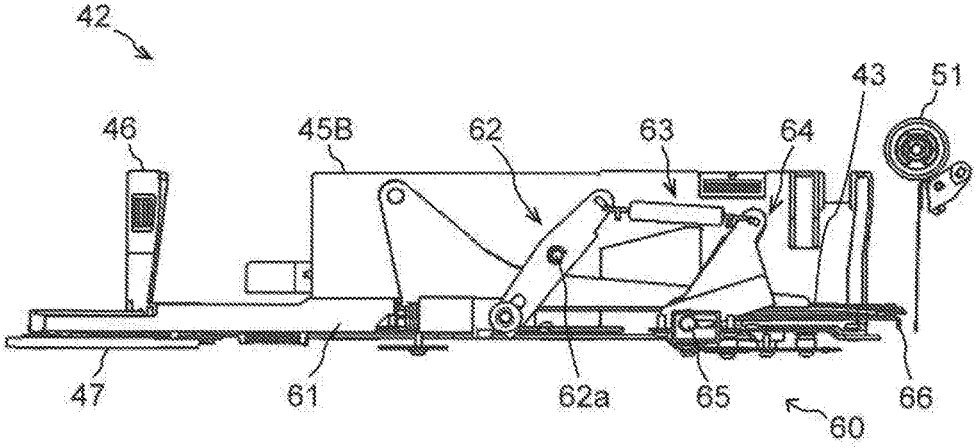
FIG. 7 is a partial front view of the sheet material feeding apparatus according to an embodiment of the present invention when a cassette is drawn out.
Figure 8:
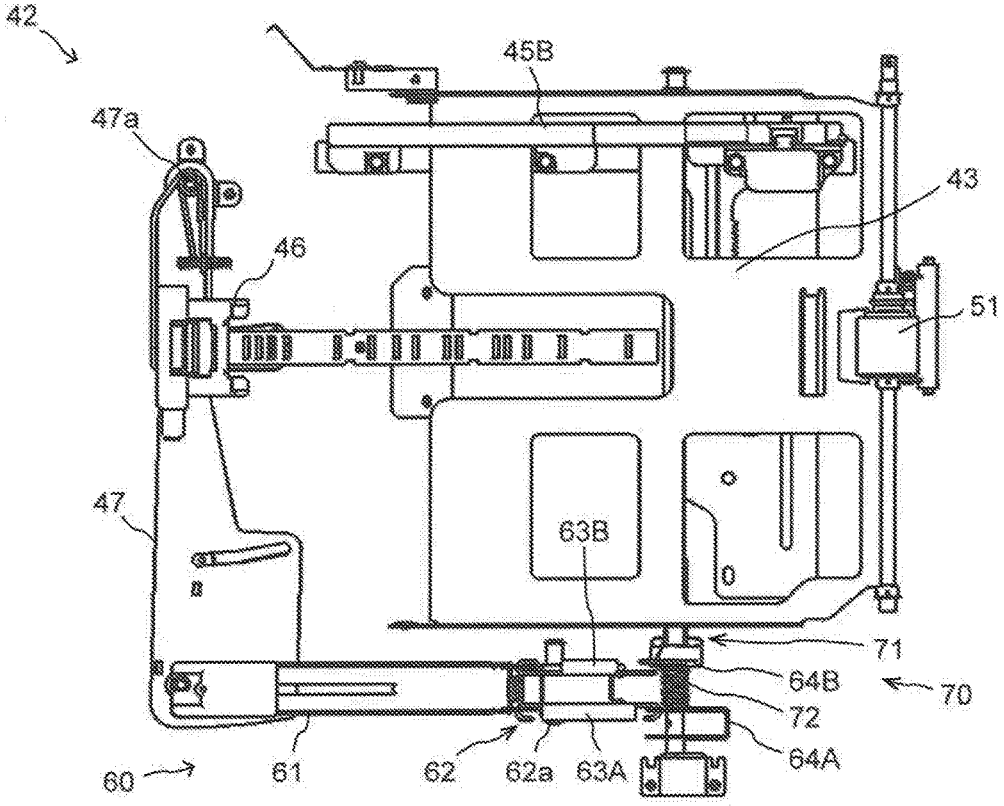
FIG. 8 is a partial plan view of the sheet material feeding apparatus according to an embodiment of the present invention when a cassette is stored.
Figure 9:
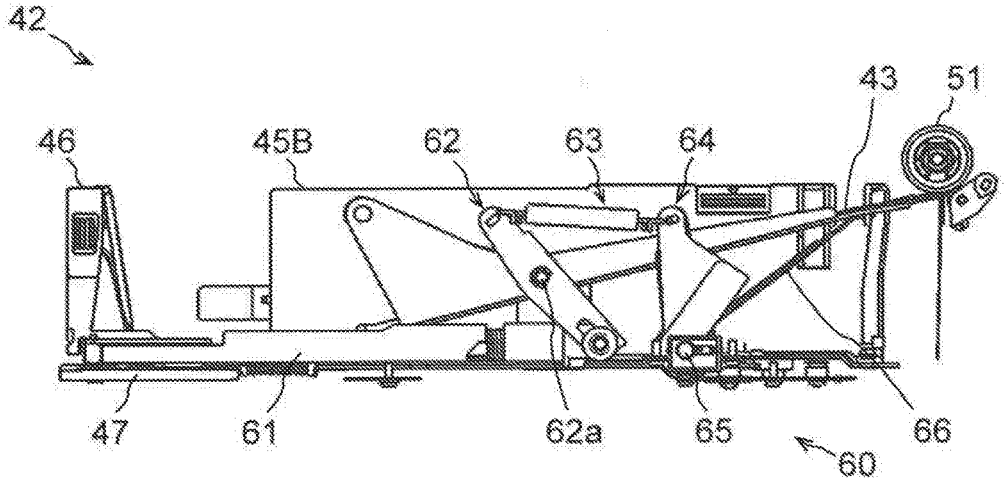
FIG. 9 is a partial front view of the sheet material feeding apparatus according to an embodiment of the present invention when a cassette is stored.

Subsequently, detailed structures of the push-up plate displacement mechanism 60 and its peripherals will be described with reference to FIGS. 6 to 9. FIGS. 6 and 7 are partial plan view and a partial front view, respectively, at the time when the cassette 42 is drawn out with respect to the housing unit 41. FIGS. 8 and 9 are partial plan view and a partial front view, respectively, at the time when the cassette 42 is stored with respect to the housing unit 41. Note that FIGS. 6 to 9 omit a drawing of the cassette 42 itself having a flat box shape with open top surface, a drawing of the width regulating member 45A on the front side of the sheet material, or the like.

As illustrated in FIGS. 6 and 7, the cassette 42 includes the push-up plate displacement mechanism 60 and a starting lever 47. The push-up plate displacement mechanism 60 changes the posture of the push-up plate 43. The starting lever 47 is used to operate the push-up plate displacement mechanism 60. The push-up plate displacement mechanism 60 includes a linear motion link 61, a pivot link 62, a push-up spring 63, a pivot lever 64, a rotation shaft 65, and a push-up lever 66.

The starting lever 47 is provided at an outer bottom portion of the cassette 42 (refer to FIG. 5). The starting lever 47 has a plate-like shape located along the bottom surface of the cassette 42 and extends in the width direction of the sheet material. The starting lever 47 is supported on an outer bottom surface of the cassette 42 via a support shaft portion 47*a* extending in a substantially vertical direction, provided at an end of the starting lever 47. The support shaft portion 47*a* is provided on a farther back side than the central portion in the width direction of the sheet material on the cassette 42, while the starting lever 47 extends from the support shaft portion 47*a* toward the front side. The starting lever 47 is rotatable around an axial line of the support shaft portion 47*a*.

The linear motion link 61 is provided at a bottom portion of the cassette 42, on the farther front side than the central portion in the width direction of the sheet material. The linear motion link 61 has an elongated shape formed along the bottom surface of the cassette 42 and extends in parallel with the feeding direction of the sheet material. The linear motion link 61 is guided by a guide material (not illustrated) and can move in parallel with the feeding direction of the sheet material. An end portion on the front side of the starting lever 47 is connected to an upstream end of the linear motion link 61 in the feeding direction of the sheet material. A lower end of the pivot link 62 is connected to the downstream end in the feeding direction of the sheet material. Note that the linear motion link 61 can slightly be displaced to the front side and the back side in accordance with the rotation of the starting lever 47.

The pivot link 62 is provided in a region that corresponds to the downstream end of the linear motion link 61 in the feeding direction of the sheet material, that is, on the front side of a substantially upstream-side section of the push-up plate 43 in the feeding direction of the sheet material. The pivot link 62 has an elongated shape extending in a substantially up-down direction. The pivot link 62 is supported by the cassette 42 via a support shaft portion 62*a* provided at a substantially central portion in the up-down direction, extending substantially horizontally in a width direction of the sheet material. The pivot link 62 can rotate around an axial line of the support shaft portion 62*a* either clockwise or counterclockwise in front view (refer to FIG. 7). A downstream end of the linear motion link 61 in the feeding direction of the sheet material is connected to the lower end of the pivot link 62. An upstream end of the push-up spring 63 in the feeding direction of the sheet material is connected to the upper end of the pivot link 62.

The push-up spring 63 extends from the region that corresponds to the upper end of the pivot link 62 toward the downstream side in the feeding direction of the sheet material. The push-up spring 63 is a push-up plate biasing member formed with an extension coil spring, for example, and includes a first push-up spring 63A and a second push-up spring 63B. The first, push-up spring 63A and the second push-up spring 63B are arranged side by side in the width direction of the sheet material. The first push-up spring 63A has greater elasticity than the elasticity of the second push-up spring 63B. Note that hereinafter, these two springs will be collectively referred to, in some cases, as the "push-up spring 63" unless there is a need to distinguish between each other.

An upper end of the pivot link 62 is connected to the upstream end of the push-up spring 63 in the feeding direction of the sheet material. An upper end of the pivot lever 64 is connected to the downstream end in the feeding direction of the sheet material. The push-up spring 63 applies elasticity (biasing force) by tension to a portion between the upper end of the pivot link 62 and the upper end of the pivot lever 64.

The push-up spring 63 biases the starting lever 47 in a direction of rotating around the axial line of the support shaft portion 47*a* via the pivot link 62 and the linear motion link 61. With this operation, in a case where the cassette 42 is in a state of being drawn out from the housing unit 41, the starting lever 47 partially protrudes to the outer side of the outer wall surface 42*a* (refer to FIG. 5) on the upstream side of the cassette 42 in the feeding direction of the sheet material.

The pivot lever 64 is provided in a region that corresponds to the downstream end of the push-up spring 63 in the feeding direction of the sheet material, that is, on the front side of substantially central portion of the push-up plate 43 in the feeding direction of the sheet material. The pivot lever 64 includes a first pivot lever 64A and a second pivot lever 64B. the first pivot lever 64A and the second pivot lever 64B are arranged side by side in the width direction of the sheet material. Note that hereinafter, these two levers will be collectively referred to, in some cases, as the "pivot levers 64" unless there is a need to distinguish between each other.

The pivot lever 64 has an elongated shape extending in a substantially up-down direction. A lower end of the first pivot lever 64A is fixed to the rotation shaft 65 extending substantially horizontally in the width direction of the sheet material. A lower end of the second pivot lever 64B is rotatably supported by the rotation shaft 65 via a biasing member selecting mechanism 70 described below. The two pivot levers 64 can independently rotate around an axial line of the rotation shaft 65 either clockwise or counterclockwise in front view (refer to FIG. 7). The downstream end of the first push-up spring 63A in the feeding direction of the sheet material is connected to the upper end, that is, a free end, of the first pivot lever 64A. The downstream end of the second push-up spring 63B in the feeding direction of the sheet material is connected to the upper end, that is, a free end, of the second pivot lever 64B. The distances between the connection positions of the push-up springs 63 in the two pivot levers 64 to the axial line center of the rotation shaft 65 are equal to each other.

As illustrated in FIG. 6, the rotation shaft 65 is arranged below the substantially central portion of the push-up plate 43 in the feeding direction of the sheet material, that is, in the vicinity of the inner bottom surface of the cassette 42. The rotation shaft 65 extends in the width direction of the sheet material, relatively across long portions from the front side to the back side of the push-up plate 43, with both ends thereof being rotatably supported by the cassette 42.

The push-up lever 66 is arranged below the downstream side portion of the feeding direction of the push-up plate 43, that is, a central portion of the push-up plate 43 in the width direction of the sheet material. The upper surface of the push-up lever 66 has a plate-like shape and substantially faces the lower surface of the push-up plate 43. A portion on a side of the push-up lever 66 extending in the width direction of the sheet material, on the upstream end in the feeding direction of the sheet material, is attached to the rotation shaft 65. The push-up lever 66 extends toward the outer side in the diameter direction of the rotation shaft 65, and toward the downstream side in the feeding direction of the sheet material. The downstream end of the push-up lever 66 in the feeding direction of the sheet material comes in contact with the lower surface of the push-up plate 43. The push-up lever 66 rotates around the axial line of the rotation shaft 65 in accordance with the rotation of the rotation shaft 65.

In a case where the cassette 42 is stored in the housing unit 41, the starting lever 47 comes in contact with the inner wall of the housing unit 41, and the starting lever 47 as a whole is retracted to the inside of the outer wall surface 42*a* on the upstream side of the cassette 42 in the feeding direction of the sheet material, as illustrated in FIGS. 8 and 9. This operation causes the starting lever 47 to press the linear motion link 61 toward the downstream side in the feeding direction of the sheet material, and the linear motion link 61 further rotates the pivot link 62 counterclockwise in front view. Subsequently, the push-up spring 63 rotates, with its biasing force, the pivot lever 64 counterclockwise in front view. The rotation shaft 65 is also rotated counterclockwise in front view with the rotation of the pivot lever 64, whereby the push-up lever 66 pushes up the downstream side portion of the push-up plate 43 in the feeding direction of the sheet material, from below the push-up plate 43. This operation allows the top layer of the sheet materials mounted on the top surface of the push-up plate 43 to reach a predetermined feeding position that comes in contact with the peripheral surface of the feed roller 51.

In a case where the cassette 42 is drawn out from the housing unit 41, the contact of the starting lever 47 with the inner wall of the housing unit 41 is released and the starting lever 47 partially protrudes to the outside of the outer wall surface 42*a* on the upstream side of the cassette 42 in the feeding direction of the sheet material by the biasing force of the push-up spring 63, as illustrated in FIGS. 6 and 7. This operation causes the starting lever 47 to pull the linear motion link 61 toward the upstream side in the feeding direction of the sheet material, and the linear motion link 61 further rotates the pivot link 62 clockwise in front view. The pivot lever 64 is also rotated clockwise in front view via the push-up spring 63. Subsequently, the push-up lever 66 is folded onto the inner bottom surface of the cassette 42, while the push-up plate 43 is also folded onto the inner bottom surface of the cassette 42.

In this manner, the starting lever 47 stores the cassette 42 into the housing unit 41 and comes in contact with the housing unit 41, thereby activating the biasing force of the push-up spring 63 in the push-up plate displacement mechanism 60 so as to change the posture of the push-up plate 43 such that it is pushed up. This enables the top layer of the sheet material to move automatically to the predetermined feeding position.

The cassette 42 includes the biasing member selecting mechanism 70. The biasing member selecting mechanism 70 switches application and release-application of the biasing force of the second push-up spring 63B among the two push-up springs 63, to the posture change of the push-up plate 43, in interlocking with displacement of the width regulating member 45A.

Figure 10:
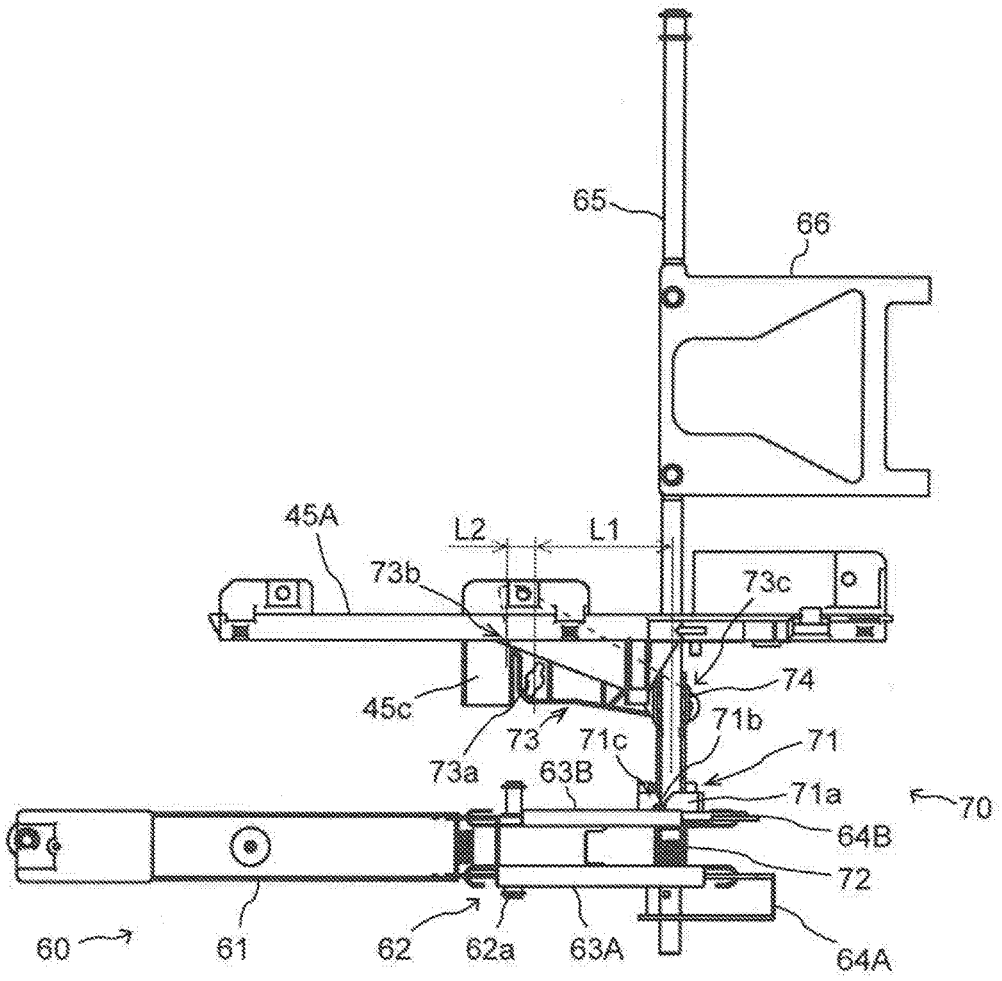
FIG. 10 is a partial plan view of the sheet material feeding apparatus according to an embodiment of the present invention when a cassette contains large-sized sheet material.
Figure 11:
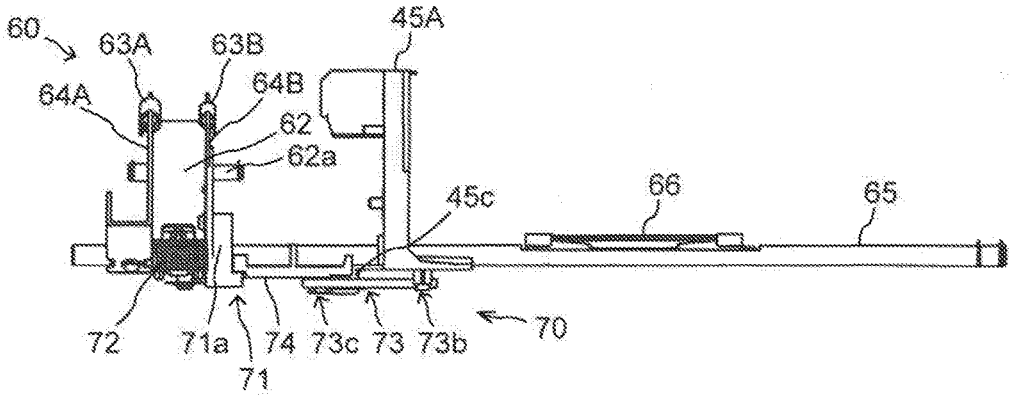
FIG. 11 is a partial side view of the sheet material feeding apparatus according to an embodiment of the present invention when a cassette contains a large-sized sheet material.
Figure 12:
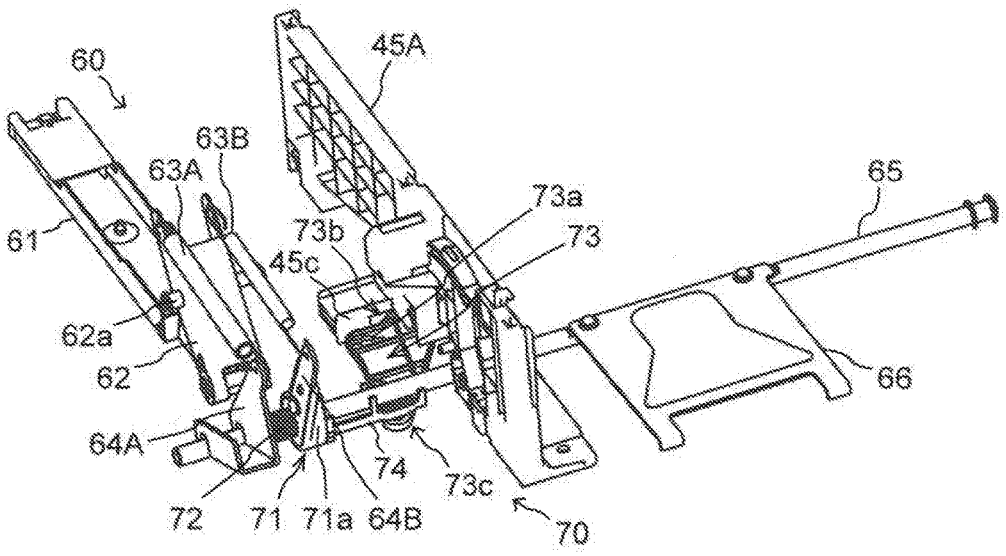
FIG. 12 is a first perspective view of the sheet material feeding apparatus according to an embodiment of the present invention when a cassette contains a large-sized sheet material.
Figure 13:
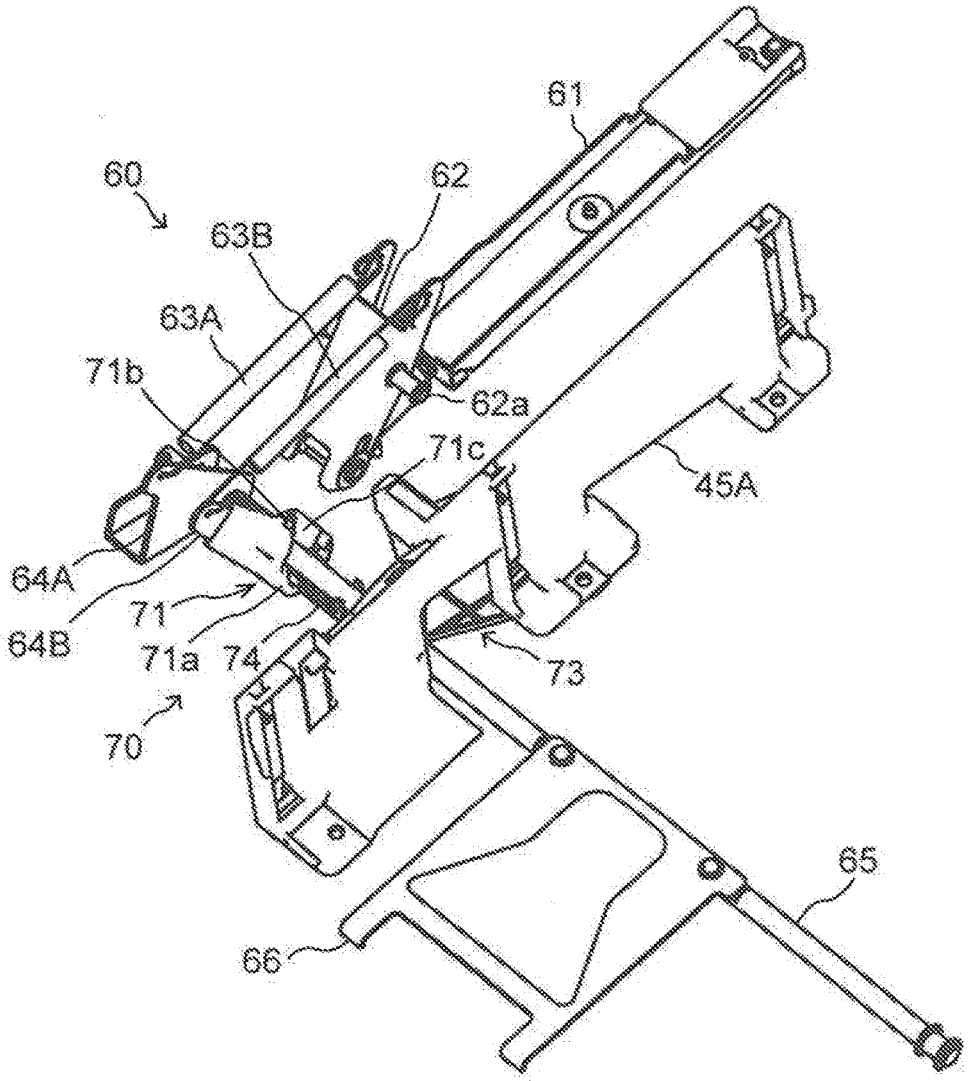
FIG. 13 is a second perspective view of the sheet material feeding apparatus according to an embodiment of the present invention when a cassette contains a large-sized sheet material.
Figure 14:
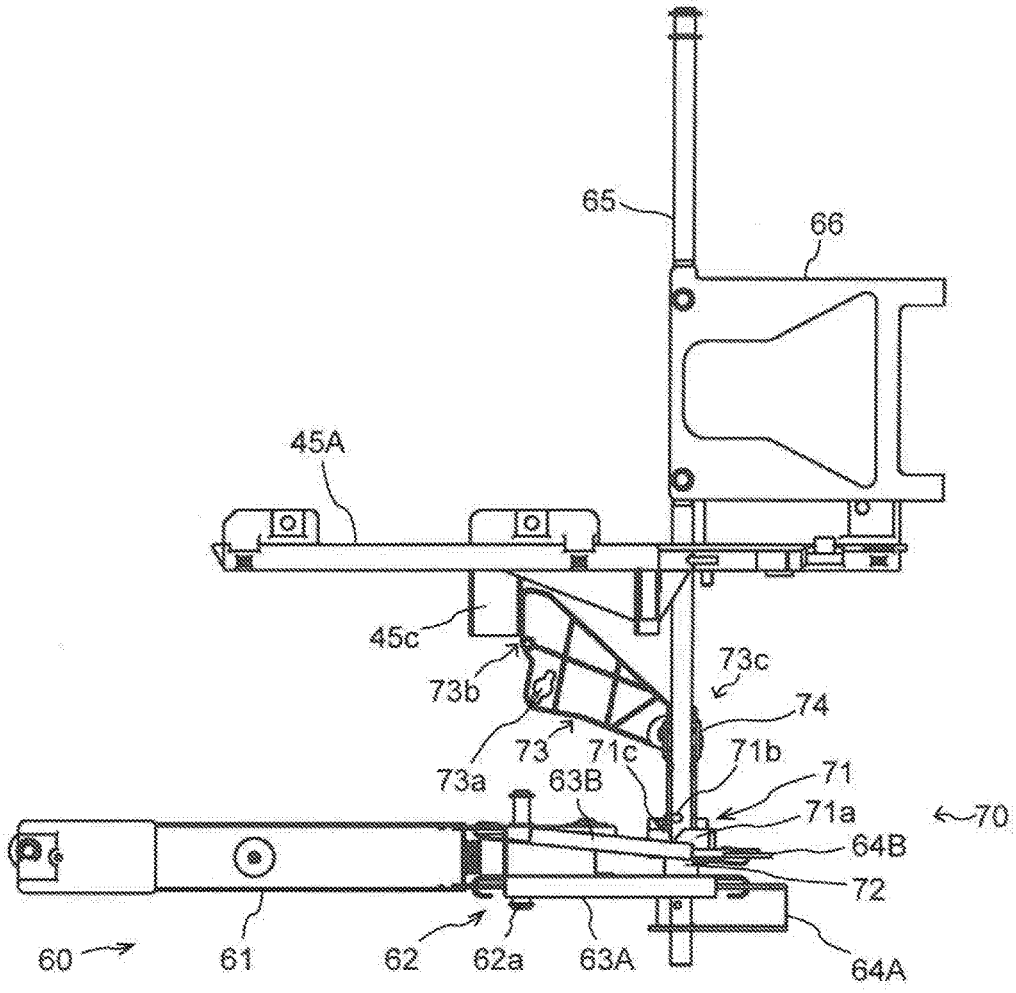
FIG. 14 is a partial plan view of the sheet material feeding apparatus according to an embodiment of the present invention when a cassette contains a small-sized sheet material.
Figure 15:
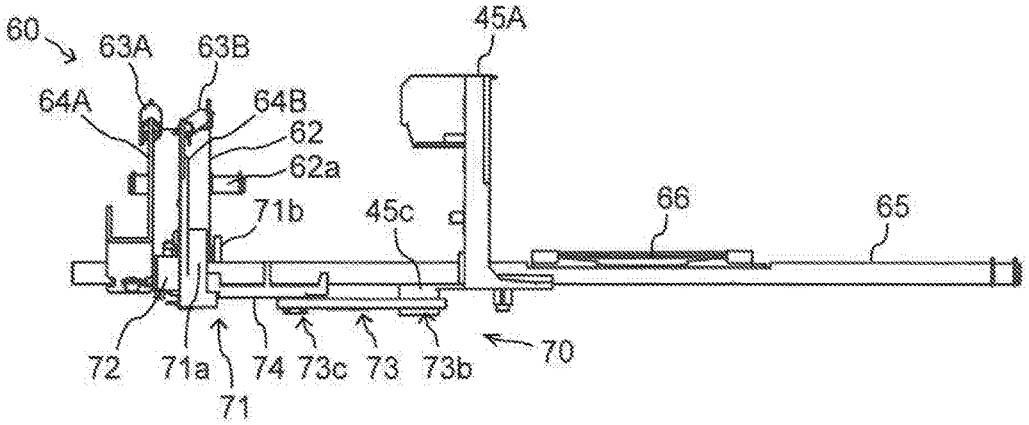
FIG. 15 is a partial side view of the sheet material feeding apparatus according to an embodiment of the present invention when a cassette contains small-sized sheet material.
Figure 16:
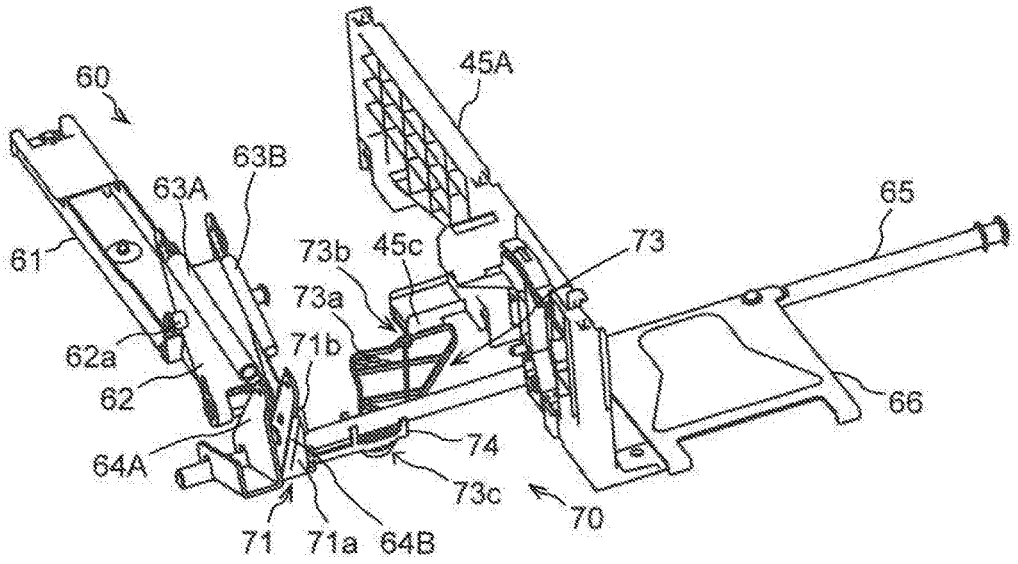
FIG. 16 is a first perspective view of the sheet material feeding apparatus according to an embodiment of the present invention when a cassette contains a small-sized sheet material.
Figure 17:
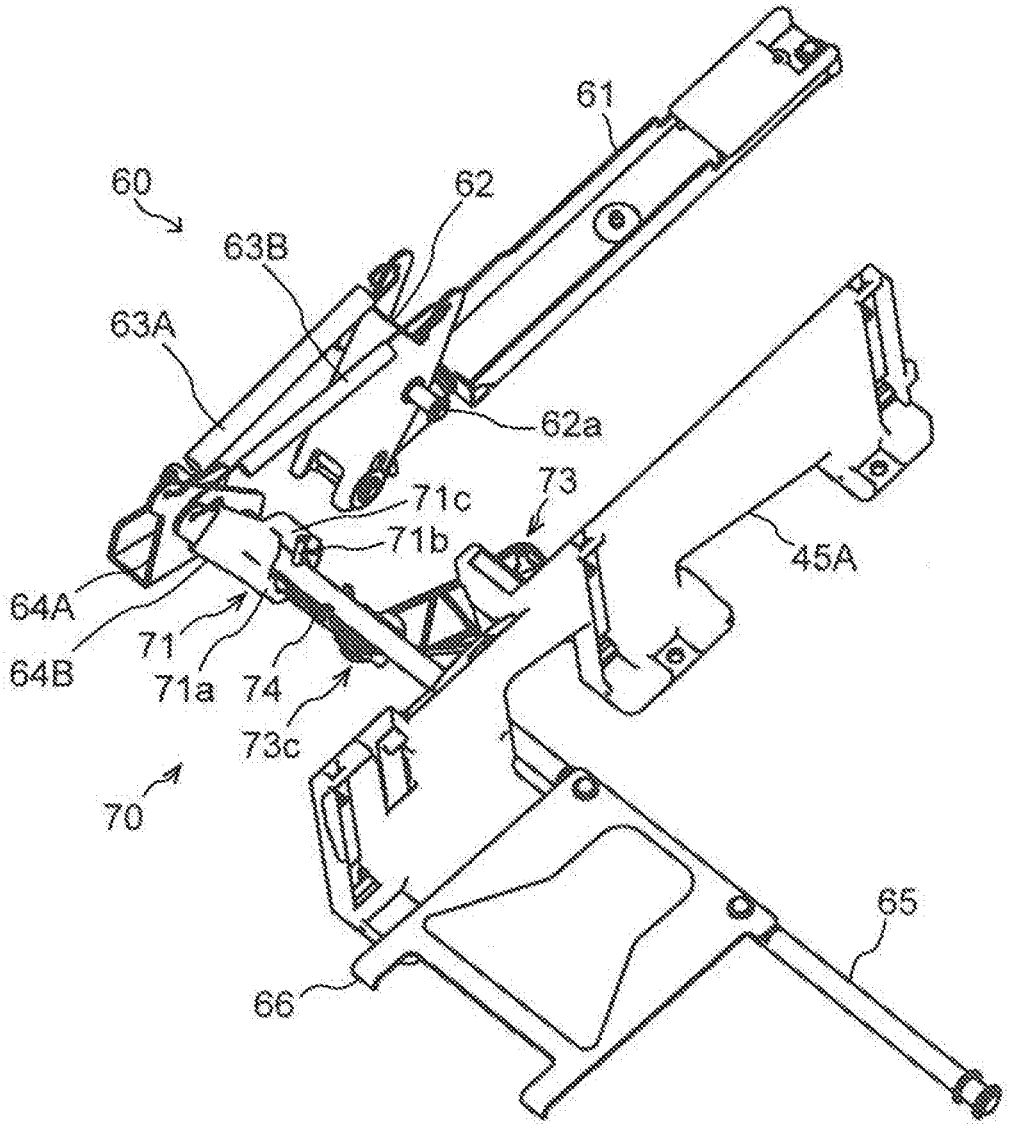
FIG. 17 is a second perspective view of the sheet material feeding apparatus according to an embodiment of the present invention when a cassette contains a small-sized sheet material.

Subsequently, the configuration of the biasing member selecting mechanism 70 will be described with reference to FIGS. 10 to 17. FIGS. 10 and 11 are a partial plan view and a partial side view, respectively, at the time when the cassette 42 contains a large-sized sheet material. FIGS. 12 and 13 are perspective views when the cassette 42 containing the large-sized sheet material is viewed from different directions. FIGS. 14 and 15 are a partial plan view and a partial side view, respectively, at the time when the cassette 42 contains a small-sized sheet material. FIGS. 16 and 17 are perspective views when the cassette 42 containing the small-sized sheet material is viewed from different directions. Note that FIGS. 10 to 17 omit drawings of the cassette 42 itself, the push-up plate 43, the width regulating member 45B on the back side of the sheet material, the rear-end regulating member 46, the starting lever 47, or the like.

In a similar manner as above, the lower side in FIGS. 10 and 14, and the left side in FIGS. 11 and 15 correspond to the front side of the sheet material feeding apparatus 40. The upper side in FIGS. 10 and 14, and the right side in FIGS. 11 and 15 correspond to the back side of the sheet material feeding apparatus 40. Similarly, the left-right direction in FIGS. 10 and 14 corresponds to the left-right direction of the sheet material feeding apparatus 40. The up-down direction in FIGS. 11 and 15 corresponds to the up-down direction of the sheet material feeding apparatus 40.

Herein, the description assumes that an exemplary "small-sized" sheet material is a typical postcard-sized sheet material. That is, the small-sized sheet material has a width of 100 mm, for example. Herein, the description assumes that the "large-sized" sheet material is a sheet material having a size exceeding a typical postcard-size. That is, the large-sized the sheet material corresponds to B5, A4, and B4 sheets. Note that these definitions and values are examples and may be optionally changed appropriately.

As illustrated in FIGS. 10 to 13, the biasing member selecting mechanism 70 is arranged at a peripheral portion of the rotation shaft 65 of the push-up plate displacement mechanism 60. The biasing member selecting mechanism 70 includes a switching unit 71, an engagement biasing spring 72, a disengagement lever 73, and a slide piece 74.

The switching unit 71 is arranged at the lower end of the second pivot lever 64B, that is, a support portion of the second pivot lever 64B on the rotation shaft 65. The switching unit 71 includes a coupling member 71*a*, and an engagement pin 71*b*.

The coupling member 71*a* is fixed on the lower end of the second pivot lever 64B. The coupling member 71*a* has a cylindrical shape with its axial line matching with the rotational axial line of the rotation shaft 65. The rotation shaft 65 penetrates through the center of the coupling member 71*a*. The coupling member 71*a* can rotate around the axial line of the rotation shaft 65, independent of the rotation shaft 65. The coupling member 71*a* can be displaced in a direction parallel with the rotational axial line of the rotation shaft 65. That is, the second pivot lever 64B can also be displaced in a direction parallel with the rotational axial line of the rotation shaft 65.

The coupling member 71*a* includes a recess 71*c* arranged at one position on an end surface of the back side of the coupling member 71*a*, in a circumferential direction. The recess 71*c* is recessed from an end surface on the back side toward the front side, on the coupling member 71*a*. The recess 71*c* has a shape and size that can allow insertion of the engagement pin 71*b*.

One engagement pin 71*b* is fixed to the rotation shaft 65. The engagement pin 71*b* protrudes from the peripheral surface of the rotation shaft 65 toward the outside in the diameter direction. The engagement pin 71*b* has a shape and size that can be inserted into the recess 71*c* of the coupling member 71*a*. When the coupling member 71*a* is displaced in a direction parallel with the rotation axial line of the rotation shaft 65, the engagement pin 71*b* appears and disappears onto the inner portion of the recess 71*c*, making it possible to engage with or disengage from the coupling member 71*a*. In this manner, the switching unit 71 includes the coupling member 71*a* capable of engaging and disengaging the second pivot lever 64B to which the second push-up spring 63B is connected, with the rotation shaft 65.

Note that the engagement pin 71*b* and the recess 71*c* are arranged side by side in parallel with the rotational axial line of the rotation shaft 65 in a state where the push-up lever 66 is folded onto the inner bottom surface of the cassette 42, as illustrated in FIGS. 10 and 14. That is, the second pivot lever 64B and the rotation shaft 65 can be engaged with each other by the switching unit 71 in a state where the push-up plate 43 is folded onto the inner bottom surface of the cassette 42.

The engagement biasing spring 72 is arranged on the farther front, side than the second pivot lever 64B. The engagement biasing spring 72 is formed with a compression coil spring, for example, and the rotation shaft 65 penetrates through the axial line center of the engagement biasing spring 72. The engagement biasing spring 72 is arranged between the first pivot lever 64A and the second pivot lever 64B. Since the first pivot lever 64A is fixed onto the rotation shaft 65, the engagement biasing spring 72 biases the second pivot lever 64B, which can be displaced in a direction parallel with the rotational axial line of the rotation shaft 65, in the direction of separating away from the first pivot lever 64A. That is, the engagement biasing spring 72 biases the second pivot lever 64B to which the second push-up spring 63B is connected, in an engagement direction with the rotation shaft 65, on the switching unit 71. In order to engage the second pivot lever 64B with the rotation shaft 65, on the switching unit 71, the engagement biasing spring 72 is configured to allow the force of 0.2N, for example, to act.

The disengagement lever 73 is arranged on an inner bottom surface of the cassette 42, on a farther back side than the switching unit 71. The disengagement lever 73 has a plate-like shape located along the bottom surface of the cassette 42 and extends in the feeding direction of the sheet material. The disengagement lever 73 includes a support shaft portion 73*a*, a contact portion 73*b*, and a joint portion 73*c*.

The support shaft portion 73*a* is arranged between the contact portion 73*b* and the joint portion 73*c*, with respect to the feeding direction of the sheet material. The support shaft portion 73*a* extends in a substantially vertical direction. The disengagement lever 73 is rotatable within a plane parallel to the inner bottom surface of the cassette 42, around the axial line of the support shaft portion 73*a*.

The contact portion 73*b* is provided at an end portion on a more upstream side than the support shaft portion 73*a*, in the feeding direction of the sheet material. A contact piece 45*c* is fixed onto the width regulating member 45A, corresponding to the contact portion 73*b* of the disengagement lever 73. The contact piece 45*c* is provided at a bottom portion of the width regulating member 45A and protrudes toward the front side. The contact portion 73*b* has a height same as the height of the contact piece 45*c*, and is positioned on a more downstream side than the contact piece 45*c* in the feeding direction of the sheet material.

When the width regulating member 45A is displaced in the width direction of the sheet material, a wall surface on the downstream side of the contact piece 45*c* of the width regulating member 45A in the feeding direction of the sheet material comes in contact with a wall surface on the upstream side of the contact portion 73*b* of the disengagement lever 73 in the feeding direction of the sheet material (refer to FIG. 14). With this operation, the disengagement lever 73 is rotationally displaced around the axial line of the support shaft portion 73*a*.

The joint portion 73*c* is provided at an end portion on a more downstream side than the support shaft portion 73*a*, in the feeding direction of the sheet material. The joint portion 73*c* is positioned below the rotation shaft 65. The joint portion 73*c* is rotatably connected with the slide piece 74 around an axial line extending in a substantially vertical direction.

The slide piece 74 is positioned below the rotation shaft 65, being arranged along the peripheral surface of the rotation shaft 65. The slide piece 74 extends in parallel with the rotational axial line of the rotation shaft 65, from the position of the joint portion 73*c* on the disengagement lever 73 to a position to reach the back-side end surface of the coupling member 71*a*. The slide piece 74 can be slide-displaced in parallel with the rotational axial line of the rotation shaft 65. That is, the slide piece 74 is slide-displaced in parallel with the rotational axial line of the rotation shaft 65 in accordance of the rotational displacement of the disengagement lever 73.

In the case of containing a large-sized sheet material inside the cassette 42, the width regulating member 45A is arranged at a relatively front side as illustrated in FIGS. 10 to 13. In this case, since the contact piece 45*c* of the width regulating member 45A does not come in contact with the contact portion 73*b* of the disengagement lever 73, the disengagement lever 73 is not rotationally displaced, and thus, the slide piece 74 would not receive the rotational force of the disengagement lever 73. With this configuration, the second pivot lever 64B receives the biasing force of the engagement biasing spring 72 to engage with the rotation shaft 65 on the switching unit 71.

Accordingly, when the biasing force of pushing up the push-up plate 43 is acted on the push-up plate displacement mechanism 60 along with the storage of the cassette 42 into the housing unit 41, the first pivot lever 64A and the second pivot lever 64B rotate together. That is, the biasing force by the second push-up spring 63B is also given in addition to the biasing force by the first push-up spring 63A, in response to the posture change of the push-up plate 43. With this mechanism, in a case where the large-sized sheet material is contained inside the cassette 42, it is possible to change the posture of the push-up plate 43 using relatively a large biasing force.

Meanwhile, in the case of containing a large-sized sheet material inside the cassette 42, the width regulating member 45A is arranged on a relatively back side as illustrated in FIGS. 14 to 17. In this case, the contact piece 45*c* of the width regulating member 45A comes in contact with the contact portion 73*b* of the disengagement lever 73 to cause the disengagement lever 73 to be rotationally displaced. After obtaining the rotational force of the disengagement lever 73, the slide piece 74 presses the end surface of the coupling member 71*a* from the back side to the front side. This operation displaces the second pivot lever 64B to be displaced onto the front side against the biasing force of the engagement biasing spring 72, and releases the engagement with the rotation shaft 65, on the switching unit 71.

Accordingly, when the biasing force of pushing up the push-up plate 43 acts on the push-up plate displacement mechanism 60 together with the storage of the cassette 42 into the housing unit 41, the second pivot lever 64B does not rotate while the first pivot lever 64A rotates. That is, the biasing force by the first push-up spring 63A solely acts in response to the posture change of the push-up plate 43, while application of the biasing force by the second push-up spring 63B is released. With this mechanism, in a case where the small-sized sheet material is contained inside the cassette 42, it is possible to change the posture of the push-up plate 43 using relatively a small biasing force.

As the above-described embodiment, the sheet material feeding apparatus 40 includes the biasing member selecting mechanism 70 having, in the cassette 42, the switching unit 71 for switching application and release-application of the biasing force of the second push-up spring 63B to the posture change of the push-up plate 43, in interlocking with displacement of the width regulating member 45A. With this configuration, it is possible to easily displace the width regulating member 45A regardless of drawn out/stored states of the cassette 42 with respect to the housing unit 41, and to switch application and release-application of the biasing force by the second push-up spring 63B to the posture change of the push-up plate 43. Moreover, since the switching unit 71 is positioned between the width regulating member 45A and the second push-up spring 63B, it is possible to suppress application of unintentional force to the width regulating member 45A and to stabilize the sheet material feeding performance. Moreover, since the push-up plate displacement mechanism 60 and the biasing member selecting mechanism 70 are provided on the cassette 42, it is possible to form the sheet material feeding apparatus 40 in relatively a small size.

Moreover, the biasing member selecting mechanism 70 includes the switching unit 71, the engagement biasing spring 72, and the disengagement lever 73. The switching unit 71 includes the coupling member 71*a* capable of performing engagement/disengagement of the second pivot lever 64B with the rotation shaft 65. The engagement biasing spring 72 biases the second pivot lever 64B in a direction to engage with the rotation shaft 65. The disengagement lever 73 is displaced in interlocking with the displacement of the width regulating member 45A, and displaces the second pivot lever 64B in a direction to disengage from the rotation shaft 65. With this configuration, it is possible to easily switch application and release-application of the biasing force of the second push-up spring 63B to the posture change of the push-up plate 43, in interlocking with displacement of the width regulating member 45A. In addition, it is possible to suppress the force needed for engagement/disengagement, on the switching unit 71 to a relatively small force, and to suppress the force needed for operating the width regulating member 45A to a relatively small force.

Moreover, one end of each of the first push-up spring 63A and the second push-up spring 63B is individually connected with the first pivot lever 64A and the second pivot lever 64B, respectively, while the first push-up spring 63A and the second push-up spring 63B can rotate, together with the single rotation shaft 65, around the axial line of the rotation shaft 65. This configuration enables suppressing variation of the biasing force of the first push-up spring 63A and the second push-up spring 63B to a relatively small level. Accordingly, it is possible to stabilize the posture change of the push-up plate 43.

Moreover, the direction of the biasing force of the engagement biasing spring 72 received at a contact position on the width regulating member 45A, with the disengagement lever 73, is parallel with the feeding direction of the sheet material. With this configuration, it is possible suppress the influence on the biasing force of the engagement biasing spring 72 caused by positional regulation by the width regulating member 45A in the width direction of the sheet material. Accordingly, it is possible to suitably achieve positioning of the sheet material in the width direction.

In addition, as illustrated in FIG. 10, a distance L1 from a rotation center of the disengagement lever 73 to a connection position of the disengagement lever 73 with the switching unit 71 in the feeding direction of the sheet material is longer than a distance L2 from a rotation center of the disengagement lever 73 to a contact position of the disengagement lever 73 with the width regulating member 45A in the feeding direction of the sheet material. Exemplary setting would be such that distance L1:distance L2 is 5:1. With this configuration, the longer the distance L1 relative to the distance L2, the smaller the amount of displacement of the width regulating member 45A needed for disengagement between the second pivot lever 64B and the rotation shaft 65 on the switching unit 71. Accordingly, it is possible to suitably switch application and re lease-application of the biasing force of the second push-up spring 63B in interlocking with the displacement of the width regulating member 45A to the posture change of the push-up plate 43.

Note that the scope of the present invention is not limited to the above-described embodiments but includes various modifications of each of the above-described embodiments without departing from the scope and spirits of the present invention. Also it is possible to perform implementation of the present invention by combining a plurality of embodiments.

For example, while the above-described embodiments assume there are two push-up springs 63 and two pivot levers 64, and the variation of the biasing force of the push-up spring 63 is two stages corresponding to the large-sized and small-sized sheet materials, the configuration is not limited to these. That is, it is allowable to provide three or more push-up springs 63 and three or more pivot levers 64, and allowable to configure such that the biasing force corresponding to the sheet materials with various sizes is applied to the posture change of the push-up plate 43.

In the above-described embodiments, the image forming apparatus 1 is a tandem type color printing image forming apparatus configured to sequentially overlap images with a plurality of colors using the intermediate transfer belt 11. It is, however, not limited to this apparatus type, but may be non-tandem type color printing image forming apparatus or monochrome printing image forming apparatus.

The present invention is applicable on an image forming apparatus such as a copier.

Although the present invention has been described and illustrated in detail, it is clearly understood that the same is by way of illustrated and example only and is not to be taken by way of limitation, the scope of the present invention being interpreted by terms of the appended claims.

What is claimed is:

1. A sheet material feeding apparatus comprising:

a cassette configured to internally contain a sheet material;

a push-up plate that is mounted on an inner bottom surface of the cassette and that is a plate on top surface of which the sheet material is mounted;

a push-up plate displacement mechanism that is provided on the cassette and configured to include a plurality of push-up plate biasing members and to change a posture of the push-up plate using a biasing force of at least one of the push-up plate biasing members;

a width regulating member provided inside the cassette and configured to be displaced in a width direction intersecting with a feeding direction of the sheet material and to regulate a position of the sheet material in the width direction; and a biasing member selecting mechanism that is provided on the cassette and includes a switching unit configured to switch application and release-application of the biasing force of at least one of the push-up plate biasing members to a posture change of the push-up plate, in interlocking with displacement of the width regulating member;

wherein the push-up plate displacement mechanism includes:

a rotation shaft that is arranged below the push-up plate and extends in the width direction of the sheet material;

a plurality of pivot levers to which an end of at least one of the push-up plate biasing members is separately connected and capable of rotating around an axial line of the rotation shaft, together with the rotation shaft; and a push-up lever arranged below the push-up plate and configured to be attached on the rotation shaft and to change a posture of the push-up plate in accordance with rotation of the rotation shaft, and the biasing member selecting mechanism is configured such that the switching unit includes a coupling member capable of performing engagement and disengagement of the pivot lever to which at least one of the push-up plate biasing members are connected, with the rotation shaft, and the biasing member selecting mechanism includes:

an engagement biasing member configured to bias, on the switching unit, the pivot lever to which at least one of the push-up plate biasing members is connected, in a direction to engage with the rotation shaft; and a disengagement lever configured to come in contact with the width regulating member, and configured to displace, on the switching unit, the pivot lever to which at least one of the push-up plate biasing members is connected, in a direction to disengage from the rotation shaft, by being displaced in interlocking with displacement of the width regulating member.

2. The sheet material feeding apparatus according to claim 1, wherein an end of each of the push-up plate biasing members is separately connected to each of the plurality of pivot levers and the plurality of pivot levers can rotate, together with the rotation shaft, around an axial line of the rotation shaft.

3. The sheet material feeding apparatus according to claim 1, wherein the direction of the biasing force of the engagement biasing member received at a contact position with the disengagement lever, on the width regulating member, is parallel with the feeding direction of the sheet material.

4. The sheet material feeding apparatus according to claim 3, wherein the disengagement lever can rotate within a plane parallel with an inner bottom surface of the cassette, and a distance from a rotation center of the disengagement lever to a connection position of the disengagement lever with the switching unit in the feeding direction of the sheet material is longer than a distance from the rotation center of the disengagement lever to a contact position of the disengagement lever with the width regulating member in the feeding direction of the sheet material.

5. The sheet material feeding apparatus according to claim 1, further comprising a housing unit, wherein the cassette can be drawn out from or stored into the housing unit, and the cassette includes a starting lever connected to the push-up plate displacement mechanism and configured to come in contact with the housing unit together with the storage of the cassette into the housing unit to change the posture of the push-up plate so as to be pushed up by activating the biasing force of the push-up plate biasing member in the push-up plate displacement mechanism.

6. An image forming apparatus comprising:

a sheet material feeding apparatus configured to feed a sheet material; and a printing unit configured to form an image on the sheet material fed from the sheet material feeding unit, wherein the sheet material feeding apparatus includes:

a cassette configured to internally contain the sheet material;

a push-up plate that is mounted on an inner bottom surface of the cassette and that is a plate on top surface of which the sheet material is mounted;

a push-up plate displacement mechanism that is provided on the cassette and configured to include a plurality of push-up plate biasing members and to change a posture of the push-up plate using a biasing force of at least one of the push-up plate biasing members;

a width regulating member provided inside the cassette and configured to be displaced in a width direction intersecting with a feeding direction of the sheet material and to regulate a position of the sheet material in a width direction; and a biasing member selecting mechanism that is provided on the cassette and includes a switching unit configured to switch application and release-application of the biasing force of at least one of the push-up plate biasing members to a posture change of the push-up plate, in interlocking with displacement of the width regulating member;

wherein the push-up plate displacement mechanism includes:

a rotation shaft that is arranged below the push-up plate and extends in the width direction of the sheet material;

a plurality of pivot levers to which an end of at least one of the push-up plate biasing members is separately connected and capable of rotating around an axial line of the rotation shaft, together with the rotation shaft; and a push-up lever arranged below the push-up plate and configured to be attached on the rotation shaft and to change a posture of the push-up plate in accordance with rotation of the rotation shaft, and the biasing member selecting mechanism is configured such that the switching unit includes a coupling member capable of performing engagement and disengagement of the pivot lever to which at least one of the push-up plate biasing members are connected, with the rotation shaft, and the biasing member selecting mechanism includes:

an engagement biasing member configured to bias, on the switching unit, the pivot lever to which at least one of the push-up plate biasing members is connected, in a direction to engage with the rotation shaft; and a disengagement lever configured to come in contact with the width regulating member, and configured to displace, on the switching unit, the pivot lever to which at least one of the push-up plate biasing members is connected, in a direction to disengage from the rotation shaft, by being displaced in interlocking with displacement of the width regulating member.

7. The image forming apparatus according to claim 6, wherein an end of each of the push-up plate biasing members is separately connected to each of the plurality of pivot levers and the plurality of pivot levers can rotate, together with the rotation shaft, around an axial line of the rotation shaft.

8. The image forming apparatus according to claim 6, wherein the direction of the biasing force of the engagement biasing member received at a contact position with the disengagement lever, on the width regulating member, is parallel with the feeding direction of the sheet material.

9. The image forming apparatus according to claim 8, wherein the disengagement lever can rotate within a plane parallel with an inner bottom surface of the cassette, and a distance from a rotation center of the disengagement lever to a connection position of the disengagement lever with the switching unit in the feeding direction of the sheet material is longer than a distance from the rotation center of the disengagement lever to a contact position of the disengagement lever with the width regulating member in the feeding direction of the sheet material.

10. The image forming apparatus according to claim 6, wherein the sheet material feeding apparatus further includes a housing unit, the cassette can be drawn out from or stored into the housing unit, and the cassette includes a starting lever connected to the push-up plate displacement mechanism and configured to come in contact with the housing unit together with the storage of the cassette into the housing unit to change the posture of the push-up plate so as to be pushed up by activating the biasing force of the push-up plate biasing member in the push-up plate displacement mechanism.

* * * * *